US009091231B2

(12) United States Patent
Yamada et al.

(10) Patent No.: US 9,091,231 B2
(45) Date of Patent: Jul. 28, 2015

(54) REGULATING DEVICE FOR ADJUSTMENT ANGLE OF PILOT SCREW FOR CARBURETOR

(71) Applicant: Mikuni Corporation, Tokyo (JP)

(72) Inventors: Hiroo Yamada, Odawara (JP); Satoshi Murooka, Odawara (JP); Satoshi Fukaura, Odawara (JP); Naomi Seto, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 14/365,425

(22) PCT Filed: Dec. 6, 2012

(86) PCT No.: PCT/JP2012/081645
§ 371 (c)(1),
(2) Date: Jun. 13, 2014

(87) PCT Pub. No.: WO2013/094425
PCT Pub. Date: Jun. 27, 2013

(65) Prior Publication Data

US 2014/0331972 A1 Nov. 13, 2014

(30) Foreign Application Priority Data

Dec. 21, 2011 (JP) ..... 2011-279300

(51) Int. Cl.
*F02M 7/00* (2006.01)
*F02M 19/04* (2006.01)
*F02M 3/10* (2006.01)

(52) U.S. Cl.
CPC *F02M 19/04* (2013.01); *F02M 3/10* (2013.01)

(58) Field of Classification Search
CPC ..... F02M 2003/105
USPC ..... 123/437; 261/36.2, 71; 251/90, 92, 93; 137/382, 382.5
See application file for complete search history.

(56) References Cited

U.S. PATENT DOCUMENTS 2,590,217 A * 3/1952 Snyder et al. ..... 55/417
5,236,634 A * 8/1993 Hammett et al. ..... 261/71

(Continued)

FOREIGN PATENT DOCUMENTS

JP 56-142255 U 10/1981
JP 56-142256 U 10/1981

(Continued)

*Primary Examiner* — Hung Q Nguyen
(74) *Attorney, Agent, or Firm* — Novak Druce Connolly Bove + Quigg LLP

(57) ABSTRACT

Provided are a tamper cap (30) which synchronously rotates a pilot screw (20) as being fitted to the pilot screw (20), engaging portions ($\mathbf{26}_{-1}$, $\mathbf{26}_{-2}$, 33) which engage the pilot screw (20) and the tamper cap (30), a plurality of elastically deforming portions ($\mathbf{25}_{-1}$, $\mathbf{25}_{-2}$) to which the tamper cap (30) is fitted, and a holding member (40) which is press-fitted to a groove (24) formed at a center part of the elastically deforming portions ($\mathbf{25}_{-1}$, $\mathbf{25}_{-2}$) and which maintains the engaged state by preventing elastic deformation of the elastically deforming portions ($\mathbf{25}_{-1}$, $\mathbf{25}_{-2}$). Owing to that the tamper cap (30) is made of metal, the pilot screw (20) and the tamper cap (30) are stiffly fixed with a mechanical structure without using glue, while increasing non-destructivity compared to a resin-made tamper cap.

3 Claims, 2 Drawing Sheets

(56) References Cited

U.S. PATENT DOCUMENTS

| | | | | | |
|---|---|---|---|---|---|
| 5,252,261 | A * | 10/1993 | Gerhardy | 261/71 |
| 5,525,267 | A * | 6/1996 | Araki | 261/71 |
| 5,772,927 | A * | 6/1998 | Koizumi et al. | 261/67 |
| 6,003,845 | A * | 12/1999 | Kus | 261/39.4 |
| 6,543,752 | B2 * | 4/2003 | Gerhardy | 261/71 |
| 2005/0173816 | A1 * | 8/2005 | Vick et al. | 261/71 |

FOREIGN PATENT DOCUMENTS

| | | | |
|---|---|---|---|
| JP | 64-063453 | A | 3/1989 |
| JP | 08-319893 | A | 12/1996 |
| JP | 55-97221 | U | 12/2000 |

* cited by examiner

REGULATING DEVICE FOR ADJUSTMENT ANGLE OF PILOT SCREW FOR CARBURETOR

CROSS REFERENCE TO RELATED APPLICATIONS

This application is a National Phase filing under 35 U.S.C. §371 of PCT/JP2012/081645 filed on Dec. 6, 2012; and this application claims priority to Application No. 2011-279300 filed in Japan on Dec. 21, 2011. The entire contents of each of these application is hereby incorporated by reference.

TECHNICAL FIELD

The present invention relates to a regulating device for adjustment angle of a pilot screw for a carburetor. In particular, the present invention is suitable to be applied to a device for regulating adjustment angle of a pilot screw which is screwed for adjusting opening area of a pilot outlet hole of a carburetor into a predetermined range using a tamper cap.

BACKGROUND ART

Traditionally, carburetors are used in combustion engines using fuel such as gasoline as devices to cause fuel to be atomized and mixed with air. Normally, a pilot outlet hole is formed in a carburetor and opening area thereof is adjusted by screwing the pilot screw, so that quantity of fuel to be mixed with air can be adjusted. That is, when the opening area of the pilot outlet hole is reduced by screwing-in the pilot screw, quantity of fuel in mixture can be reduced. On the other hand, when the opening area of the pilot outlet hole is increased by releasing the pilot screw, quantity of fuel in the mixture can be increased.

Here, when the opening area of the pilot outlet hole is adjustable without limitation, there may be a case that exhaust gas after gasoline is combusted exceeds predetermined regulation values. In order to make the opening area of the pilot outlet hole adjustable only within the exhaust gas regulation, it is required to regulate adjustment angle (rotatable range) of the pilot screw.

Conventionally, a tamper cap has been arranged at a pilot screw as means for regulating adjustment angle of the pilot screw (for example, see Patent Literature 1). Here, when the tamper cap is rotated, a projection portion of the tamper cap is stopped by a stopper member of a carburetor body. Accordingly, the adjustment angle of the pilot screw which is rotated in synchronization with the tamper cap is regulated into a predetermined range.

In a case of using a tamper cap, to reliably meet the exhaust gas regulation, the tamper cap is required not to easily drop as being fixed to the pilot screw. In most cases of the related art including Patent Literature 1, resin-made tamper caps have been used. With a resin-made tamper cap, the tamper cap is easily broken when an excessive force is applied. In this case, there has been a possibility that the pilot screw becomes rotatable without limitation.

Meanwhile, metal-made tamper caps have been proposed. When a metal-made tamper cap is used, glue is generally used as fixing means for a pilot screw. In a case that a tamper cap is made of metal, there is an advantage that risk of being broken by an excessive force is reduced compared to a resin-made tamper cap.

That is, non-destructivity of the metal-made tamper cap is improved compared to a resin-made tamper cap. However, there has been a problem that the tamper cap drops from the pilot screw causing the pilot screw to be in a state of being rotatable without limitation when an excessive force more than bonding strength of glue is applied. In addition, there has been a problem that the tamper cap drops from the pilot cap due to poor bonding or time degradation.

Besides the structure using a tamper cap, the related art includes a structure that a hole plug is arranged for a pilot screw. However, the structure with a hole plug has a disadvantage that a pilot screw cannot be adjusted at all.

CITED LITERATURE

Patent Literature

Patent Literature 1: Japanese Utility Model No. 2585288

SUMMARY OF THE INVENTION

To address the above issues, an object of the present invention is to prevent occurrence of dropping of a tamper cap as being reliably fixed to a pilot screw while rotational angle of the pilot screw is adjustable within a predetermined regulation range.

To solve the above problems, a regulating device for adjustment angle of a pilot screw according to the present invention includes a metal-made tamper cap which synchronously rotates the pilot screw as being engaged with the pilot screw, and a stopper member which regulates rotational angle of the tamper cap into a predetermined range as causing a projection portion of the tamper cap to be stopped. Here, a plurality of elastically deforming portions which are elastically deformable in a direction perpendicular to a longitudinal axis direction are arranged at a tailing end part in the longitudinal axis direction of the pilot screw as forming a groove at a center part thereof. Further, engaging portions which are mutually engaged when the tamper cap is assembled to the tamper cap are arranged at the elastic deforming portions and the tamper cap. Further, a holding member is arranged for maintaining an engaged state between the pilot screw and the tamper cap as causing the elastically deforming portions to be incapable of elastically deforming by being inserted to the groove after the tamper cap and the pilot screw are engaged as being assembled while the plurality of elastically deforming portions are elastically deformed.

According to the present invention having the abovementioned structure, since the metal-made tamper cap is adopted, the tamper cap has less risk to be broken with an excessive force than a resin-made tamper cap. Further, according to the present invention, the pilot screw and the tamper cap are not fixed with glue but are fixed due to the elastically deforming portion and the engaging portion formed at the tamper cap. Then, the engaged state is stiffly maintained by the holding member inserted to the groove formed at the center part of the elastically deforming portion. Accordingly, it is possible to prevent occurrence of dropping of the tamper cap from the pilot screw due to an excessive force. Thus, according to the present invention, occurrence of dropping of the tamper cap can be prevented as being reliably fixed to the pilot screw while the rotational angle of the pilot screw is adjustable within the predetermined regulation range.

EMBODIMENT OF THE INVENTION

Figure 1:
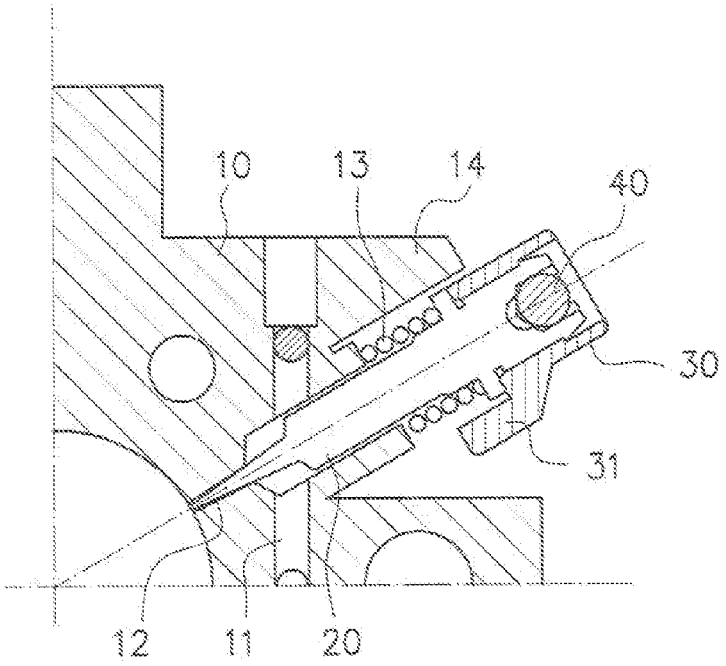
FIG. 1 is a longitudinal sectional view illustrating a state that a tamper cap is fitted to a pilot screw mounted on a carburetor.
Figure 2:
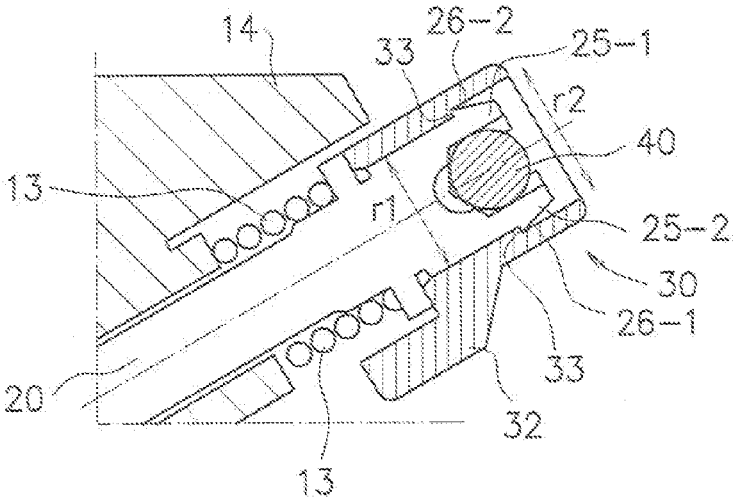
FIG. 2 is a longitudinal sectional view as being a partially-enlarged view of FIG. 1 illustrating a configuration example of a regulating device for adjustment angle of a pilot screw according to the present embodiment.
Figure 3:
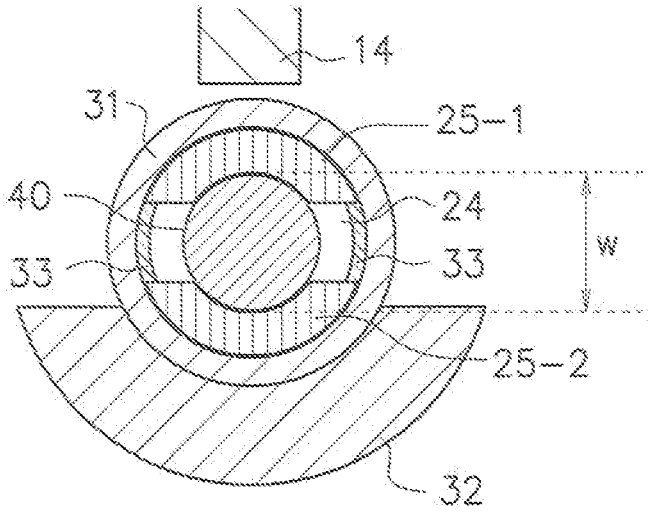
FIG. 3 is a top view illustrating a configuration example of the regulating device for adjustment angle of the pilot screw according to the present embodiment.
Figure 4:
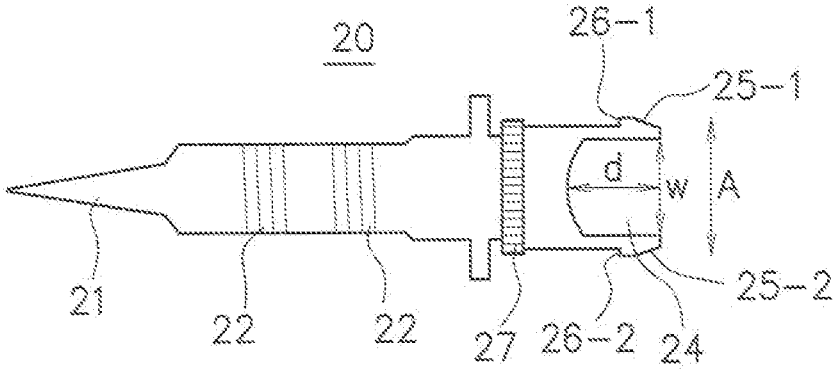
FIG. 4 is a view illustrating a configuration example of the pilot screw according to the present embodiment.

In the following, an embodiment of the present invention will be described based on the attached drawings. FIG. 1 is a longitudinal sectional view illustrating a state that a tamper cap is fitted to a pilot screw mounted on a carburetor. FIG. 2 is a longitudinal sectional view as being a partially-enlarged view of FIG. 1 illustrating a configuration example of a regulating device for adjustment angle of a pilot screw according to the present embodiment. FIG. 3 is a top view illustrating a configuration example of the regulating device for adjustment angle of the pilot screw according to the present embodiment. FIG. 4 is a view illustrating a configuration example of the pilot screw according to the present embodiment.

As illustrated in FIG. 1, a carburetor 10 includes a fluid passage 11 through which fluid such as gasoline flows. A pilot outlet hole 12 is formed as an end part of the fluid passage 11. A pilot screw 20 is screwed into the carburetor 10 and a tamper cap 30 is fitted to a tailing end part of the pilot screw 20. Further, a ball-shaped holding member 40 is press-fitted into a groove (mentioned in detail later) which is formed at the tailing end part of the pilot screw 20. The pilot screw 20 is made, for example, of metal such as brass. Further, the tamper cap 30 is made, for example, of metal such as zinc.

As illustrated in FIG. 4, a leading end part of the pilot screw 20 is formed as a taper-shaped needle valve portion 21. In addition, a thread groove 22 is formed at the pilot screw 20 midway in the longitudinal axis direction. Further, as illustrated in FIGS. 1 and 2, a coil spring 13 is wound to an outer circumferential portion of the pilot screw 20. Then, the needle valve portion 21 is inserted to the pilot outlet hole 12 of the carburetor 10, so that opening area of the pilot outlet hole 12 can be adjusted with screwing thereof.

Two elastically deforming portions $\mathbf{25}_{-1}$, $\mathbf{25}_{-2}$ capable of elastically deforming in a direction (shown by an arrow A) perpendicular to the longitudinal axis direction are arranged at the tailing end part in the longitudinal axis direction of the pilot screw 20 so that a groove 24 is formed at the center part thereof. As illustrated in FIG. 3, the elastically deforming portions $\mathbf{25}_{-1}$, $\mathbf{25}_{-2}$ form a cross-section to have a shape obtained by eliminating a part of a ring shape having a constant width. The two elastically deforming portions $\mathbf{25}_{-1}$, $\mathbf{25}_{-2}$ are arranged at positions so as to be mutually faced with a constant distance therebetween. Thus, the groove 24 formed between the two elastically deforming portions $\mathbf{25}_{-1}$, $\mathbf{25}_{-2}$ has a cross-section being shaped approximately like a minus (−) character.

The elastically deforming portions $\mathbf{25}_{-1}$, $\mathbf{25}_{-2}$ include engaging portions $\mathbf{26}_{-1}$, $\mathbf{26}_{-2}$ for providing engagement between the pilot screw 20 and the tamper cap 30. When the tamper cap 30 is assembled to the pilot screw 20 (specifically, to a section of the elastically deforming portions $\mathbf{25}_{-1}$, $\mathbf{25}_{-2}$ located at the tailing end part thereof, as being the same hereinafter), the engaging portions $\mathbf{26}_{-1}$, $\mathbf{26}_{-2}$ are engaged respectively with an engaging portion 33 formed inside the tamper cap 30 (see FIGS. 2 and 3).

Here, each of the engaging portions $\mathbf{26}_{-1}$, $\mathbf{26}_{-2}$ of the pilot screw 20 forms a cross-section to have an arrow shape whose arrow head forms a half of a reversed-V shape. A part corresponding to the arrow head is protruded toward the outer circumferential side of the pilot screw 20. Meanwhile, the engaging portion 33 of the tamper cap 30 is formed with a step structure utilizing difference of inner diameters. That is, difference is provided between an inner diameter r1 at positions where parts corresponding to shafts of the arrow shape of the engaging portions $\mathbf{26}_{-1}$, $\mathbf{26}_{-2}$ are located and an inner diameter r2 at positions where the arrow heads are located in a state that the tamper cap 30 is fitted to the pilot screw 20. Then, the inner diameter r1 is set to be smaller than the inner diameter r2, so that the engaging portion 33 is formed at the stepped part.

Here, the inner diameter r1, being the smaller, of the tamper cap 30 is set to be the same as or slightly larger than a width between shafts in a state that the elastically deforming portions $\mathbf{25}_{-1}$, $\mathbf{25}_{-2}$ are not deformed, that is, the state that the elastically deforming portions $\mathbf{25}_{-1}$, $\mathbf{25}_{-2}$ are upright in a direction of the longitudinal axis of the pilot screw 20 (a width from an outer face of the shaft of one elastic deforming portion $\mathbf{25}_{-1}$ to an outer face of the shaft of the other elastic deforming portion $\mathbf{25}_{-2}$).

Meanwhile, the inner diameter r2, being the larger, of the tamper cap 30 is set to be slightly larger than a width between the arrow heads in a state that the elastically deforming portions $\mathbf{25}_{-1}$, $\mathbf{25}_{-2}$ are not elastically deformed (a width from an outer face of the arrow head of one elastic deforming portion $\mathbf{25}_{-1}$ to an outer face of the other elastic deforming portion $\mathbf{25}_{-2}$). The setting to be slightly larger allows the elastically deforming portions $\mathbf{25}_{-1}$, $\mathbf{25}_{-2}$ to expand toward the outer circumference side.

According to the above configuration, for fitting the tamper cap 30 to the pilot screw 20, the arrow heads of the elastically deforming portions $\mathbf{25}_{-1}$, $\mathbf{25}_{-2}$ are elastically deformed by the difference between the two inner diameters r1, r2 of the tamper cap 30 on a stage before the engaging portions $\mathbf{26}_{-1}$, $\mathbf{26}_{-2}$ of the pilot screw 20 and the engaging portion 33 of the tamper cap 30 are engaged. Subsequently, the elastically deforming portions $\mathbf{25}_{-1}$, $\mathbf{25}_{-2}$ are returned into a state without elastic deformation (a state of being upright in the longitudinal axis direction of the pilot screw 20) on a stage after the engaging portions $\mathbf{26}_{-1}$, $\mathbf{26}_{-2}$ and the engaging portion 33 are engaged.

As illustrated in FIG. 4, a thread groove 27 is formed at a root part of the elastically deforming portions $\mathbf{25}_{-}$, $\mathbf{25}_{-2}$. The thread groove 27 provides a resistance force to prevent the tamper cap 30 from dropping from the pilot screw 20 in a state that the tamper cap 30 is fitted to the pilot screw 20. For providing larger resistance force, an outer diameter of a part where the thread groove 27 is formed is set to be slightly larger than the inner diameter r1, being the smaller, of the tamper cap 30. Here, the outer diameter of the part where the thread groove 27 is formed is smaller than the inner diameter r2, being the lager, of the tamper cap 30.

As described above, the tamper cap 30 is fitted to the pilot screw 20 in a state that the engaging portion 33 formed at the inside thereof and the engaging portions $\mathbf{26}_{-1}$, $\mathbf{26}_{-2}$ formed at the elastically deforming portions $\mathbf{25}_{-1}$, $\mathbf{25}_{-2}$ of the pilot screw 20 are engaged. Here, the fitting state is strengthened with the resistance force provided by the thread groove 27. When an operator rotates the tamper cap 30 by hand in the above state, the pilot screw 20 is rotated in synchronization with the tamper cap 30.

As illustrated in FIG. 3, the tamper cap 30 has a structure in which a projection portion 32 is formed at a main body portion 31 which has an approximately cylindrical shape. The projection portion 32 forms a cross-section to have a shape obtained by eliminating a part of a ring shape having a constant width. Meanwhile, as illustrated in FIGS. 2 and 3, the carburetor 10 includes a stopper member 14 which regulates rotational angle of the tamper cap 30 into a predetermined range by causing the projection portion 32 of the tamper cap 30 to be stopped thereby. Thus, owing to the projection portion 32 of the tamper cap 30 and the stopper member 14 of the carburetor 10, the rotational angle of the pilot screw 20 which is rotated in synchronization with the tamper cap 30 can be regulated into the predetermined range.

The holding member 40 is press-fitted to the groove 24 formed at the tailing end of the pilot screw 20 after the tamper cap 30 is fitted to the pilot screw 20 so as to maintain an engaged state between the pilot screw 20 and the tamper cap 30. In the present embodiment, the holding portion 40 has a ball-shape. Then, the diameter of the holding portion 40, that is, a width thereof in a direction perpendicular to the longitudinal axis direction of the pilot screw 20, is set to be slightly larger than a width w of the groove 24 (see FIGS. 3 and 4) in a state that the elastically deforming portions $\mathbf{25}_{-1}$, $\mathbf{25}_{-2}$ are not elastically deformed.

As described above, when the tamper cap 30 is assembled to and fitted to the pilot screw 20 with the two elastically deforming portions $\mathbf{25}_{-1}$, $\mathbf{25}_{-2}$ elastically deformed to the inner side, the elastically deforming portions $\mathbf{25}_{-1}$, $\mathbf{25}_{-2}$ are returned into a state without elastic deformation in a state that the engaging portions $\mathbf{26}_{-1}$, $\mathbf{26}_{-2}$ and the engaging portion 33 are engaged. In the above state, the holding member 40 is press-fitted to the groove 24 which is formed at the center part between the two elastically deforming portions $\mathbf{25}_{-1}$, $\mathbf{25}_{-2}$. Since the diameter of the holding member 40 is set to be slightly larger than the width w of the groove 24, the arrow heads of the two elastically deforming portions $\mathbf{25}_{-1}$, $\mathbf{25}_{-2}$ are elastically deformed to the outer side when the holding member 40 is press-fitted to the groove 24. Accordingly, the elastically deforming portions $\mathbf{25}_{-1}$, $\mathbf{25}_{-2}$ become incapable of elastically deforming to the inner side. Thus, the engaged state between the engaging portions $\mathbf{26}_{-1}$, $\mathbf{26}_{-2}$ and the engaging portion 33 is prevented from being released.

In the present embodiment, the diameter of the holding member 40, that is, a height thereof in the longitudinal axis direction of the pilot screw 20, is set to be approximately the same as a depth d of the groove 24 (see FIG. 4). In other words, end parts of the elastically deforming portions $\mathbf{25}_{-1}$, $\mathbf{25}_{-2}$ and an end part of the holding member 40 are aligned at the same height in a state that the holding member 40 is press-fitted into the groove 24.

As described above in detail, according to the present embodiment, since the regulating device for adjustment angle of the pilot screw for a carburetor adopts the metal-made tamper cap 30, it is possible to reduce a risk of being damaged by an excessive force compared to a resin-made tamper cap.

Further, according to the present embodiment, the pilot screw 20 and the tamper cap 30 are not fixed with glue but are fixed due to the engaging portions $\mathbf{26}_{-1}$, $\mathbf{26}_{-2}$ arranged at the elastically deforming portions $\mathbf{25}_{-1}$, $\mathbf{25}_{-2}$ and the engaging portion 33 arranged at the tamper cap 30. In addition, owing to that the holding member 40 is inserted to the groove 24 which is formed at the center part between the elastically deforming portions $\mathbf{25}_{-1}$, $\mathbf{25}_{-2}$, the engaged state is stiffly maintained. Accordingly, it is possible to prevent occurrence of dropping of the tamper cap 30 from the pilot screw 20 due to an excessive force. Further, it is possible to prevent occurrence of dropping of the tamper cap 30 from the pilot screw 20 due to poor bonding or time degradation.

Consequently, according to the regulating device for adjustment angle of the pilot screw for a carburetor of the present embodiment, the tamper cap 30 can be prevented from dropping as being reliably fixed to the pilot screw 20 while rotational angle of the pilot screw 20 is kept adjustable within a predetermined regulation range.

Further, in the present embodiment, the diameter of the holding member 40 is set to be slightly larger than the width w of the groove 24. Therefore, owing to that the holding member 40 is press-fitted to the groove 24 in a state that the pilot screw 20 and the tamper cap 30 are engaged, the two elastically deforming portions $\mathbf{25}_{-1}$, $\mathbf{25}_{-2}$ are elastically deformed to the outer side. The above precludes elastic deformation of the elastically deforming portions $\mathbf{25}_{-1}$, $\mathbf{25}_{-2}$ to the inner side, so that the engaged state between the engaging portions $\mathbf{26}_{-1}$, $\mathbf{26}_{-2}$ and the engaging portion 33 can be strengthened. Here, setting the diameter of the holding member 40 to be slightly larger than the width w of the groove 24 is not essential but desirable.

Further, in the present embodiment, the diameter of the holding member 40 is set to be approximately the same as the depth d of the groove 24. Therefore, owing to that the holding member 40 is press-fitted to the groove 24, an excessive torque can be more unlikely to be applied with a screwdriver or the like inserted to the groove 24. In a case of adopting the engagement structure as described above, it is required that the groove 24 is arranged so that the engaging portions $\mathbf{26}_{-1}$, $\mathbf{26}_{-2}$ can be deformed to the inner side. In the present embodiment, owing to that the groove 24 is plugged with the holding member 40 having the height aligned thereto, it is possible to prevent the pilot screw 20 from being rotated with a screwdriver or the like inserted to the groove 24.

Further, in the present embodiment, the pilot screw 20 and the tamper cap 30 are fixed without using glue. Therefore, it is not required to perform an operation, at a production site to manage application quantity of glue having a major effect on non-destructivity of the tamper cap 30. Further, in a case of fixing with glue, it is required to perform a drying process after an applying process of glue. However, in the present embodiment, such a plurality of operational processes are not required. Here, the operation is completed only with assembling of the tamper cap 30 to the pilot screw 20 and press-fitting of the holding member 40 to the groove 24 of the pilot screw 20. Accordingly, compared to the related art using a metal-made tamper cap, there is an advantage that production efficiency is improved.

In the present embodiment, description is performed on an example that two elastically deforming portions $\mathbf{25}_{-1}$, $\mathbf{25}_{-2}$ are provided and the groove 24 between the two elastically deforming portions $\mathbf{25}_{-1}$, $\mathbf{25}_{-2}$ are formed into an approximately minus character shape. However, the present invention is not limited thereto. There may be provided three or more elastically deforming portions. For example, it is possible that four elastically deforming portions are provided and the groove 24 is formed at the center part among the four elastically deforming portions into an approximately plus (+) character shape.

Further, in the present embodiment, the holding member 40 is formed into a ball shape. However, the present invention is not limited thereto. For example, the holding member 40 may be formed into a shape being the same as the groove 24. In this case, since the groove 24 is plugged completely with press-fitting of the holding member 40 into the groove 24, it is possible to perfectly preclude rotation of the pilot screw 20 with a screwdriver or the like inserted to the groove 24.

Further, in the present embodiment, description is performed on an example that the pilot screw 20 and the tamper cap 30 are engaged using the arrow-shaped engaging portions $\mathbf{26}_{-1}$, $\mathbf{26}_{-2}$ and the engaging portion 33 having a step structure. However, the present invention is not limited thereto. For example, it is possible to structure engaging portions with a concave portion or a convex portion formed at an outer side face of the shafts of the elastically deforming portions $\mathbf{25}_{-1}$, $\mathbf{25}_{-2}$ and a convex portion or a concave portion formed at an inner wall face of the tamper cap 30. Here, in view of preventing the tamper cap 30 from dropping from the pilot screw 20, the structure described in the above-described embodiment is more preferable as having a stiffer engaged state.

Further, in the present embodiment, description is performed on an example that the projection portion 32 arranged at the tamper cap 30 forms a cross-section to have a shape obtained by eliminating a part of a ring shape having a constant width. However, the present invention is not limited thereto. For example, it is possible to adopt a structure to adopt two bar-shaped projection portions.

The abovementioned embodiments simply disclose examples of specifications for actualizing the present invention. The technical scope of the present invention should not be construed as being limited thereto. The present invention can be variously actualized without departing from the spirit or essential characteristics thereof.

The invention claimed is:

1. A regulating device for adjustment angle of a pilot screw for a carburetor for regulating adjustment angle of the pilot screw into a predetermined range, the pilot screw being screwed for adjusting opening area of an pilot outlet hole of the carburetor, comprising:

a metal-made tamper cap which includes a projection portion and synchronously rotates the pilot screw as being press-fitted to the pilot screw;

a stopper member which regulates rotational angle of the tamper cap into a predetermined range as causing the projection portion to be stopped;

a holding member which maintains an engaged state between the pilot screw and the tamper cap; and a plurality of elastically deforming portions which are arranged at a tailing end part in a longitudinal axis direction of the pilot screw to form a groove at a center part thereof and which are elastically deformable in a direction perpendicular to the longitudinal axis direction, wherein engaging portions for mutually engaging the pilot screw and the tamper cap are arranged at the elastically deforming portions and the tamper cap, and the elastically deforming portions are configured to be incapable of elastically deforming owing to that the holding member is press-fitted to the groove which is formed at the center part of the plurality of elastically deforming portions in a state that the tamper cap is fitted to the pilot screw.

2. The regulating device for adjustment angle of the pilot screw for the carburetor according to claim 1, wherein a width of the holding member in a direction perpendicular to the longitudinal axis direction is set to be larger than a width of the groove in a state that the elastically deforming portions are not elastically deformed.

3. The regulating device for adjustment angle of the pilot screw for the carburetor according to claim 1, wherein a height of the holding member is set to be approximately the same as a depth of the groove.

* * * * *